US009366992B2

(12) United States Patent
Hashimoto et al.

(10) Patent No.: US 9,366,992 B2
(45) Date of Patent: Jun. 14, 2016

(54) DEVELOPER CONVEYANCE MEMBER AND CORRESPONDING SUPPORT PART CONFIGURATION FOR DEVELOPER CONTAINER AND DEVELOPING DEVICE

(71) Applicants: Junichi Hashimoto, Toyohashi (JP); Shuichi Kato, Nagoya (JP)

(72) Inventors: Junichi Hashimoto, Toyohashi (JP); Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/011,107

(22) Filed: Aug. 27, 2013

(65) Prior Publication Data

US 2014/0056621 A1 Feb. 27, 2014

(30) Foreign Application Priority Data

Aug. 27, 2012 (JP) ..... 2012-186894

(51) Int. Cl.
*G03G 15/00* (2006.01)
*G03G 15/08* (2006.01)

(52) U.S. Cl.
CPC ..... *G03G 15/0867* (2013.01); *G03G 15/0889* (2013.01); *G03G 2215/0838* (2013.01)

(58) Field of Classification Search
CPC ..... G03G 15/0889; G03G 2215/0838; G03G 2215/085; G03G 15/0867
USPC ..... 399/254–255, 262–263, 111
See application file for complete search history.

(56) References Cited

U.S. PATENT DOCUMENTS

| | | | | |
|---|---|---|---|---|
| 6,470,163 | B1 * | 10/2002 | Minagawa | 399/256 |
| 7,224,925 | B2 * | 5/2007 | Sato et al. | 399/263 |
| 7,860,437 | B2 | 12/2010 | Kakuta et al. | |
| 8,005,404 | B2 * | 8/2011 | Sato | 399/252 |
| 8,238,802 | B2 * | 8/2012 | Kawakami et al. | 399/263 |
| 2008/0247784 | A1 | 10/2008 | Kakuta et al. | |
| 2010/0196059 | A1 | 8/2010 | Maeshima | |
| 2011/0076062 | A1 | 3/2011 | Kakuta et al. | |
| 2011/0158700 | A1 * | 6/2011 | Iwata | 399/254 |

(Continued)

FOREIGN PATENT DOCUMENTS

| | | | |
|---|---|---|---|
| JP | 2006064794 A | * | 3/2006 |
| JP | 2008-170951 A | | 7/2008 |
| JP | 2010-176033 A | | 8/2010 |

OTHER PUBLICATIONS

English Translation of Yamamura, Kazuyoshi. Toner Cartridge and Toner Conveying Means Used Therefor, Japanese Patent Pffice, Mar. 9, 2006. JP2006-064794.*

*Primary Examiner* — Clayton E LaBalle
*Assistant Examiner* — Trevor J Bervik
(74) *Attorney, Agent, or Firm* — Banner & Witcoff, Ltd.

(57) ABSTRACT

A developer container may include a container body accommodating developer, a conveyance member, and a rotation member having a rotary shaft and an elastic part supported by the rotation member and configured to convey the developer. The container body may include a first support part to which the rotary shaft is loosely fitted, and a second support part that supports the rotary shaft. The container body may further include a sliding contact part that the elastic part sliding-contacts while being elastically deformed when the conveyance member is being rotated. In some examples, a distance from a center of the rotary shaft to a leading end of the elastic part gradually increases from the one end portion-side of the rotary shaft towards the other end portion-side of the rotary shaft.

11 Claims, 7 Drawing Sheets

(56) References Cited

U.S. PATENT DOCUMENTS

2011/0293332 A1* 12/2011 Kawakami ..... 399/254
2012/0033999 A1* 2/2012 Ichikawa ..... 399/262
2012/0170955 A1 7/2012 Kakuta et al.
2013/0259537 A1* 10/2013 Matsumoto et al. ..... 399/263
2014/0056620 A1* 2/2014 Hashimoto et al. ..... 399/254

* cited by examiner

DEVELOPER CONVEYANCE MEMBER AND CORRESPONDING SUPPORT PART CONFIGURATION FOR DEVELOPER CONTAINER AND DEVELOPING DEVICE

CROSS-REFERENCE TO RELATED APPLICATION

This application is based upon and claims the benefit of priority of Japanese Patent Application No. 2012-186894 filed on Aug. 27, 2012, the contents of which are incorporated herein by reference in its entirety.

BACKGROUND

The invention relates to a developer container having a conveyance member that is rotated to thus convey developer in a container body to an outside of the container body, and a developing device.

A developer container has been known in which a developer accommodation unit (a container body) accommodating therein developer is arranged below a developing unit and the developer in the developer accommodation unit is conveyed to the developing unit through an opening formed at an upper part of the developer accommodation unit.

In the developer container, the developer accommodation unit is provided with a toner conveyance member (a conveyance member). The toner conveyance member is rotated with being bent while sliding-contacting an inner wall of the developer accommodation unit, thereby picking up the developer in the developer accommodation unit. When the toner conveyance member is spaced from the inner wall, it jumps out to thus scatter the picked up developer, thereby conveying the same from the opening towards the developing unit.

SUMMARY

According to the above technology, in order to stabilize a force for scattering the developer, it is important to position a rotating center in precision when the toner conveyance member (the conveyance member) is spaced from the inner wall of the developer accommodation unit (the container body). Thus, it is considered to fit a rotary shaft of the toner accommodation member to a support part that is provided to the developer accommodation unit. However, in this case, when the developer is introduced into a gap between the rotary shaft and the support part, the developer may be agglomerated.

Therefore, an object of the invention is to provide a developer container and a developing device capable of reducing a phenomenon that developer is introduced and agglomerated in a gap between a rotary shaft of a conveyance member and a support part supporting the rotary shaft and effectively conveying the developer.

A developer container comprising:

a conveyance member including a rotation member having a rotary shaft extending in a first direction, and an elastic part which is supported by the rotation member and is configured to be elastically deformed;

a driving member that is connected to one end portion of the rotary shaft and is configured to rotate the rotary shaft; and a container body configured to accommodate therein developer, the container body including:

a first side wall including a first support part configured to support the other end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening communicating an inside of the container body with an outside of the container and that the elastic part sliding-contacts while being elastically deformed when the conveyance member is being rotated, wherein a distance from a center of the rotary shaft to a leading end of the elastic part is gradually increased from the one end portion-side of the rotary shaft towards the other end portion-side of the rotary shaft.

A developing device comprising:

a developing unit that is provided with a developing roller;

a conveyance member including a rotation member having a rotary shaft extending in a first direction, and an elastic part which is supported by the rotation member and is configured to be elastically deformed; and a developer accommodation unit configured to accommodate therein developer, the developer accommodation unit including:

a first side wall including a first support part configured to support the other end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening through which the developer accommodation communicates with the developing unit and that the elastic part sliding-contacts while being elastically deformed when the conveyance member is being rotated, wherein a distance from a center of the rotary shaft to a leading end of the elastic part is gradually increased from the one end portion-side of the rotary shaft towards the other end portion-side.

BRIEF DESCRIPTION OF DRAWINGS

FIG. 4 is a sectional view of the developing cartridge, in which

DESCRIPTION OF EXEMPLARY EMBODIMENTS

Hereinafter, an exemplary embodiment will be specifically described with reference to the drawings. Meanwhile, in the below descriptions, a schematic configuration of a color printer 1 having a developing cartridge 100, which is an example of the developing device (developer container) according to this exemplary embodiment, will be first described.

In the below descriptions, a direction is described based on a user who uses the color printer 1. That is, the left side in FIG. 1 is referred to as the 'front', the right side is referred to as the 'rear', the front side is referred to as the 'right' and the inner side is referred to as the 'left.' The upper and lower directions in FIG. 1 are referred to as the 'upper-lower.'

<Schematic Configuration of Color Printer>

Figure 1:
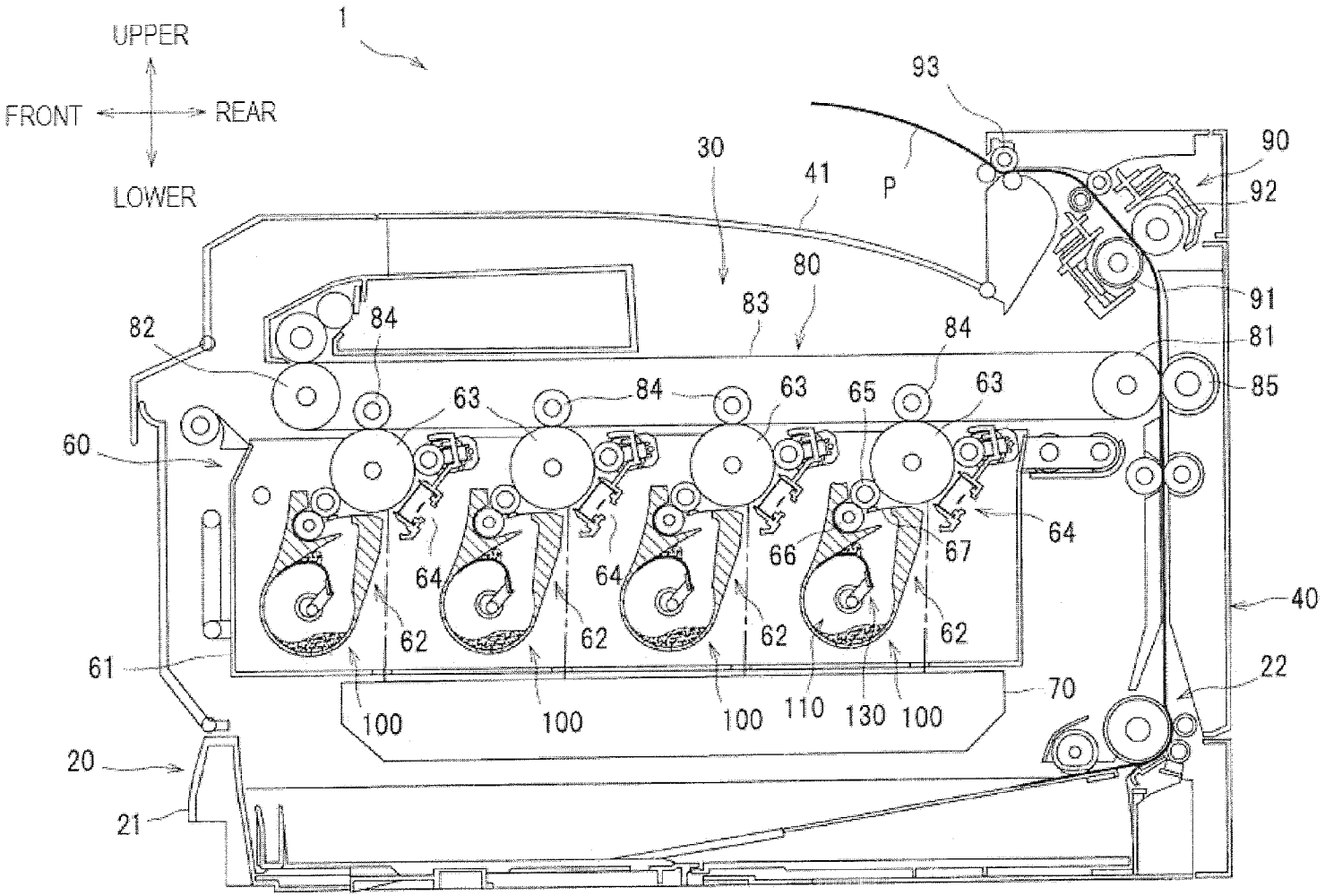
FIG. 1 shows a schematic configuration of a color printer having a developing cartridge according to an illustrative embodiment of the invention.

As shown in FIG. 1, the color printer 1 mainly has, in a body housing 40, a feeder unit 20 that feeds sheets P and an image forming unit 4 that forms an image on the fed sheet P.

The feeder unit 20 is provided at the lower in the body housing 40 and mainly has a sheet feeding tray 21 that accommodates therein the sheets P and a sheet feeding mechanism 22 that conveys the sheet P from the sheet feeding tray 21 to the image forming unit 30. The sheets P in the sheet feeding tray 21 are separated one by one and conveyed to the image forming unit 30 by the sheet feeding mechanism 22.

The image forming unit 30 mainly has an exposure unit 70, a process unit 60, a transfer unit 80 and a fixing unit 90.

The exposure unit 70 is provided above the feeder unit 20 and has a laser light source, a polygon mirror, a lens, a reflecting mirror and the like, which are not shown. A laser light emitted from the laser light source is reflected on the polygon mirror or reflecting mirror, passes through the lens and is scanned on surfaces of respective photosensitive drums 63 at high speed.

The process unit 60 is arranged above the exposure unit 70 and mainly has four process cartridges 62 that are arranged in a front-rear direction and a holding case 61 that holds the process cartridges 62.

The process cartridge 62 mainly includes the photosensitive drum 63, a charger 64 and a developing cartridge 100.

The developing cartridge 100 includes a developing roller 65, a supply roller 66, a layer thickness regulation blade 67 and a toner conveyance member 130 that is an example of the conveyance member, and accommodates toner T (developer) in a toner accommodation unit 110 (the developer accommodation unit) that is an example of the container body.

Figure 2:
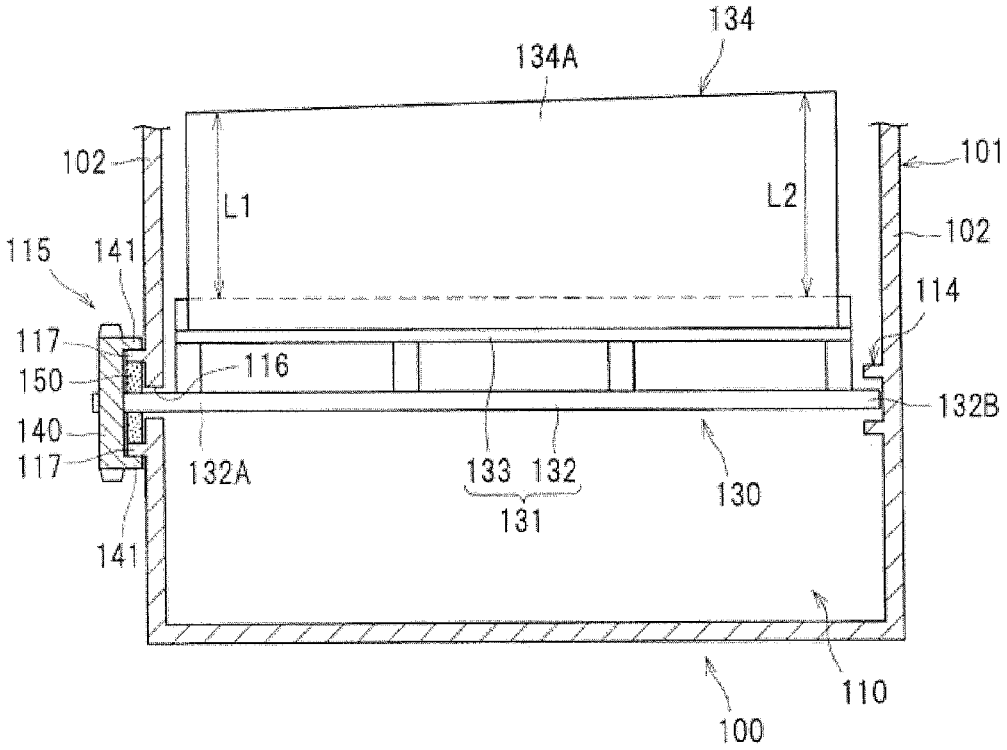
FIG. 2 is a sectional view of the developing cartridge showing a toner conveyance member, a first support part and a second support part.

As shown in FIG. 2, the toner conveyance member 130 includes a rotation member 131 and a sheet member 134.

The rotation member 131 includes a shaft part 132 that is an example of the rotary shaft and a sheet attachment part 133.

The shaft part 132 is a shaft extending along an axis direction of the developing roller 65 or supply roller 66 and is rotatably supported to the toner accommodation unit 110. A gear 140 that is an example of the driving member is fixed to one end portion 132A of the shaft part 132. The gear 140 is input with a driving force from a driving source (not shown), so that the shaft part 132 is rotated. The sheet attachment part 133 extends outwards from the shaft part 132 in a diametrical direction and includes a leading end portion to which the sheet member 134 is fixed.

The toner conveyance member 130 configured as described above is rotated about the shaft part 132 in a clockwise direction (refer to FIG. 1) to thus pick up the toner T in the toner accommodation unit 110, thereby conveying the same towards a developing unit 120 accommodating therein the developing roller 65 and the like, which will be described later.

In the meantime, the configuration of the developing cartridge 100 will be specifically described later.

<Detailed Configuration of Developing Cartridge>

Subsequently, detailed configurations of a housing 101 of the developing cartridge 100 and the toner conveyance member 130, which are features of the invention, are described.

As shown in FIG. 2, the housing 101 of the developing cartridge 100 includes a pair of sidewalls 102 that is arranged at both sides of the toner conveyance member 130 in an axis line direction and configures the toner accommodation unit 110. The pair of sidewalls 102 is provided with a first support part 114 and a second support part 115.

The first support part 114 is provided on an inner surface of the sidewall 102 that is arranged at the other end portion 132B-side of the shaft part 132 of the toner conveyance member 130. The first support part 114 is a recess part having a substantially circular shape, when seen from the side (refer to FIG. 4A) and is larger than a diameter of the shaft part 132, and the other end portion 132B of the shaft part 132 is loosely fitted therein.

Figure 3:
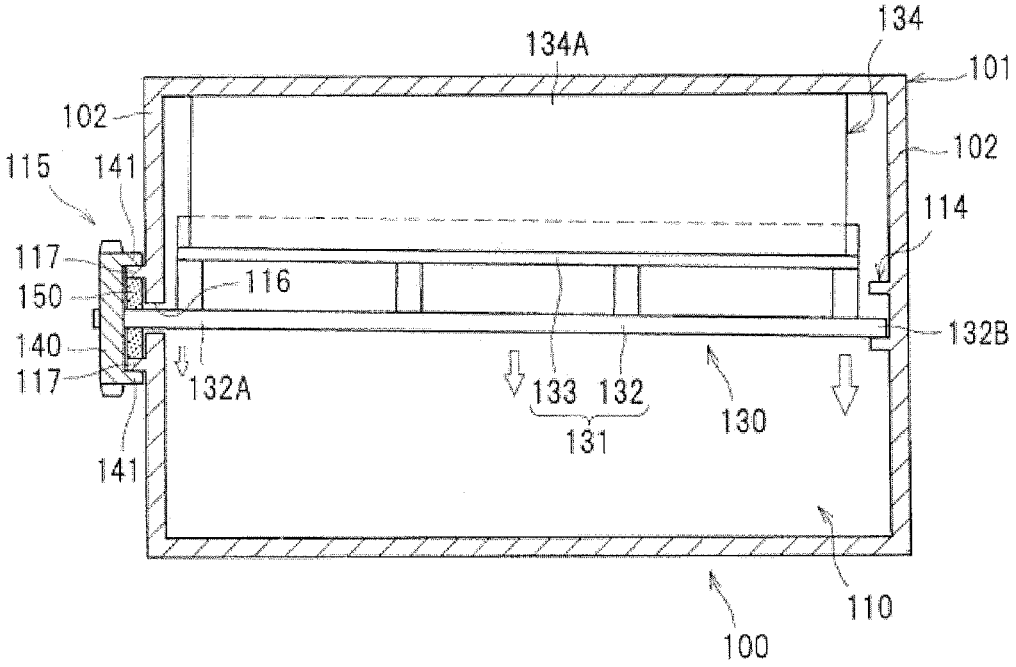
FIG. 3 is a sectional view of the developing cartridge showing the toner conveyance member when a sheet member sliding-contacts an inner surface of the developing cartridge.

As shown in FIG. 3, an inner periphery of the first support part 114 is arranged at a position at which the other end portion 132B of the shaft part 132 abuts thereon when the sheet member 134 being rotated sliding-contacts an inner periphery of the housing 101.

As shown in FIG. 2, the second support part 115 axially supports the rotation of the one end portion 132A of the shaft part 132 of the toner conveyance member 130. The second support part 115 includes a hole 116, which is formed at a position facing the first support part 114 of the sidewall 102 arranged at the one end portion 132A-side of the shaft part 132, and a gear support part 117.

The hole 116 is larger than the one end portion 132A of the shaft part 132.

The gear support part 117 protrudes from the sidewall 102 to the outside of the housing 101 and has a cylindrical shape that is coaxial with a shaft axis of the first support part 114.

Here, the gear 140 that is fixed to the one end portion 132A of the shaft part 132 of the toner conveyance member 130 includes a cylindrical part 141, which protrudes towards the sidewall 102, on a surface thereof facing the sidewall 102. An inner diameter of the cylindrical part 141 is set to be substantially the same as an outer diameter of the gear support part 117. The gear 140 is fitted to the gear support part 117 so that a rotary shaft thereof does not shake. Thereby, shaft axes of the first support part 114 and the second support part 115 coincide with each other.

A seal member 150 is in close contact with an inner side of the gear support part 117 so that the toner is not leaked from between the gear support part 117 and the shaft part 132.

Figure 4A:
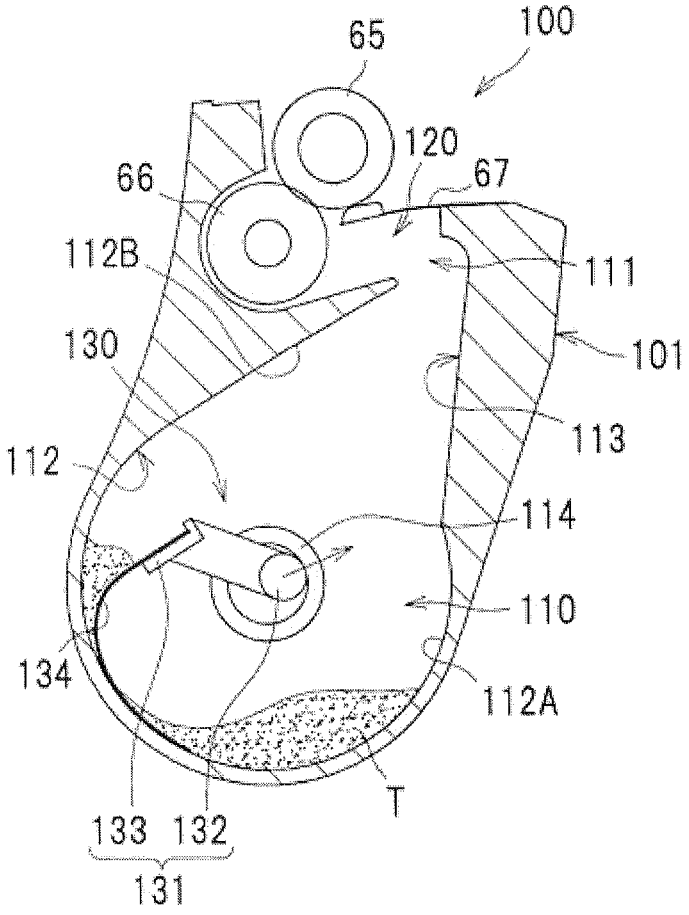
FIG. 4A shows a state where the sheet member sliding-contacts a cylindrical surface.

As shown in FIG. 4A, the housing 101 includes the toner accommodation unit 110 in which the toner conveyance member 130 is arranged and the developing unit 120 in which the developing roller 65 and the like are arranged.

The toner accommodation unit 110 includes a communication hole 111 that is an example of the opening formed at the upper thereof, and an inner space thereof communicates with an inner space of the developing unit 120, which is provided above an inclined surface 112B (which will be described later), through the communication hole 111.

The toner accommodation unit 110 includes a sliding contact part 112 and a collision part 113 in addition to the pair of sidewalls 102 and has a substantial raindrop shape, when seen from a section.

The sliding contact part 112 is an inner surface of the toner accommodation part 110 that is provided in the vicinity of an upstream side in a rotating direction of the toner conveyance member 130 (hereinafter, simply referred to as 'rotating direction') as regards the communication hole 111. The sliding contact part 112 has a cylindrical surface 112A and the inclined surface 112B.

The cylindrical surface 112A configures an inner surface of a substantial lower half of the toner accommodation unit 110 and has a substantially cylindrical shape having an open upper part. In the meantime, a radius of the cylindrical surface 112A is smaller than a length from a center of the shaft part 132 of the toner conveyance member 130 to a leading end of the sheet member 134 that is at a not-deformed state.

The inclined surface 112B is a surface that continuously extends from a downstream end portion of the cylindrical surface 112A in the rotating direction to an edge of the communication hole 111, and is formed so that a distance from a center of the cylindrical surface 112A is increased as the inclined surface comes closer to the communication hole 111.

The collision part 113 is an inner surface of the toner accommodation part 110 that is provided in the vicinity of a downstream side in the rotating direction as regards the communication hole 111. The collision part 113 extends from the communication hole 111 to an upstream end portion of the cylindrical surface 112A in the rotating direction.

As shown in FIG. 2, the toner conveyance member 130 is formed so that a distance from the center of the shaft part 132 to a leading end of the sheet member 134 is gradually increased from the one end portion 132A-side of the shaft part 132 towards the other end portion 132B-side.

Specifically, the rotation member 132 is formed so that a length from the center of the shaft part 132 to a leading end of the sheet attachment part 133, to which the sheet member 134 is attached, is substantially uniform in a range between an end portion thereof at the one end portion 132A-side of the shaft part 132 and an end portion at the other end portion 132B-side.

The sheet member 134 has a trapezoidal shape. An elastic part 134A extending from the sheet attachment part 133 of the sheet member 134 is formed so that a length L2 at an end portion of the other end portion 132B-side of the shaft part 132 is larger than a length L1 at an end portion of the one end portion 132A-side of the shaft part 132.

In the meantime, the lengths L1, L2 are set so that a difference therebetween is substantially the same as a difference between a radius of the inner periphery of the first support part 114 and a radius of the other end portion 132B of the shaft part 132.

In the below, operations of the developing cartridge 100 configured as described above are described.

When the driving force is input to the gear 140 and the toner conveyance member 130 is thus rotated, the sheet member 134 is rotated while it sliding-contacts the sliding contact part 112 with being elastically deformed and picks up the toner T in the toner accommodation unit 110.

At this time, as shown in FIG. 3, since the gear 140 is fitted in the gear support part 117, the one end portion 132A-side of the shaft part 132 is little displaced in the diametrical direction. However, the other end portion 132B-side of the shaft part 132 is displaced in the diametrical direction because it is loosely fitted in the first support part 114.

Specifically, as shown in FIG. 4A, when the sheet member 134 sliding-contacts the cylindrical surface 112A, the other end portion 132B of the shaft part 132 is moved in the first support part 114 in an opposite direction to the sheet member 134 by a reaction force that is applied to the rotation member 131.

Figure 4B:
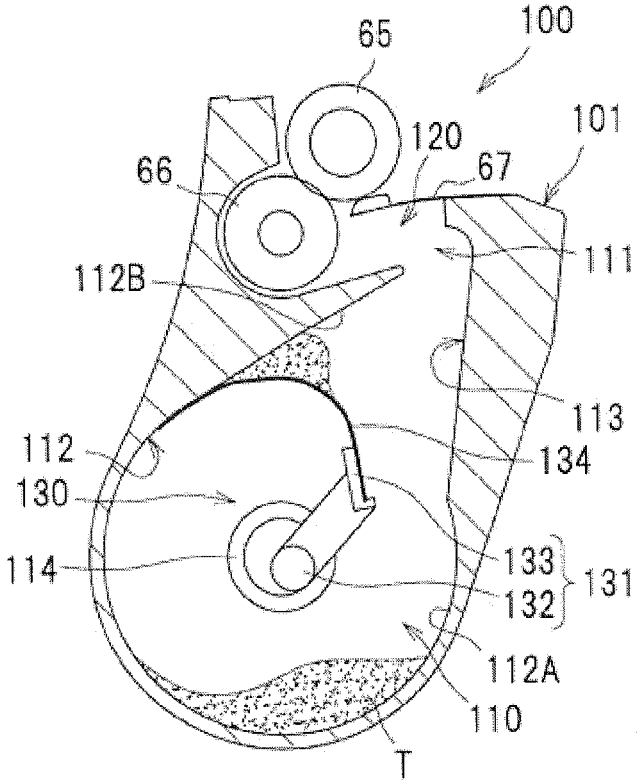
FIG. 4B shows a state where the sheet member sliding-contacts an inclined surface and FIG. 4C shows a state where the sheet member collides with a collision part.

As shown in FIG. 4B, when the sheet member 134 starts to sliding-contact the inclined surface 112B, the other end portion 132B of the shaft part 132 is moved in the first support part 114 in a direction separating from the inclined surface 112B by the reaction force that is applied to the rotation member 131.

Figure 4C:
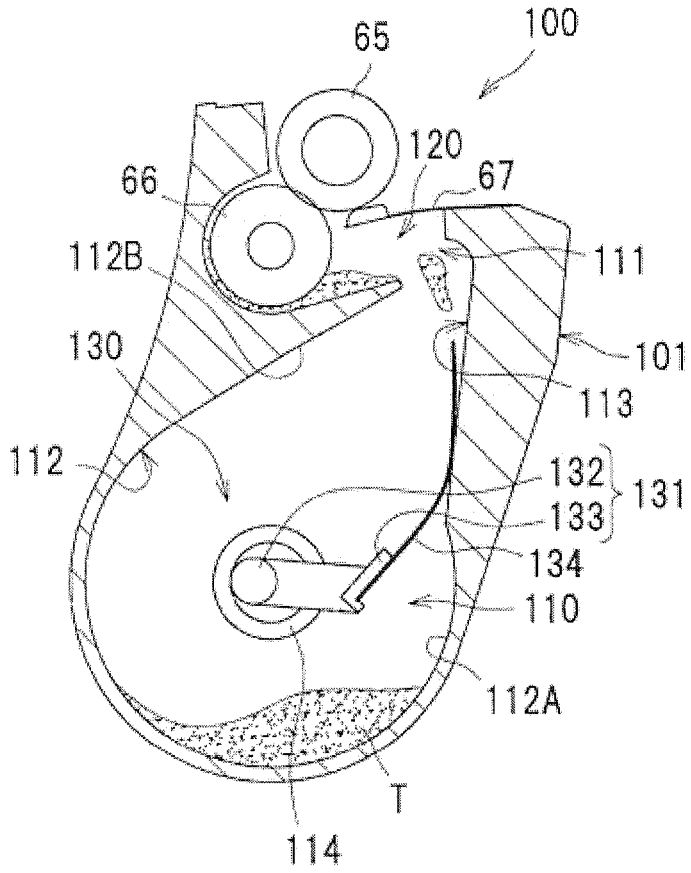

Then, when the sheet member 134 is separated from the inclined surface 112B, the leading end of the sheet member 134 jumps out by an elastic force of the sheet member 134 and thus collides with the collision part 113, as shown in FIG. 4C. Thereby, the toner T put on the sheet member 134 is scattered towards the communication hole 111 by an air stream generated by the sheet member 134 and is then supplied to the developing unit 120 (the outside of the toner accommodation unit 110).

After the collision with the collision part 113, the sheet member 134 again starts to sliding-contact the cylindrical surface 112A with being bent. At this time, the other end portion 132B of the shaft part 132 is moved in the first support part 114 in the direction separating from the collision part 113 by the reaction force applied to the rotation member 131.

As described above, when the toner conveyance member 130 is being rotated, the other end portion 132B of the shaft part 132 to which the gear 140 is not fixed is moved in the first support part 114. Therefore, even when the toner T is introduced into the gap between the shaft part 132 and the first support part 114, the toner is suppressed from being agglomerated in the gap.

In the configuration where the other end portion 132B of the shaft part 132 is moved in the first support part 114, since the distance from the center of the shaft part 132 of the toner conveyance member 130 to the leading end of the sheet member 134 is gradually increased from the one end portion 132A-side of the shaft part 132 towards the other end portion 132B-side, the other end portion-side of the sheet member 134 is not separated from the sliding contact part 112 when the one end portion-side of the sheet member 134 is sliding-contacting the sliding contact part 112. Thereby, since the toner conveyance member 130 can convey the toner T over the entire axial direction, it is possible to effectively convey the toner T.

In the above illustrative embodiment, the shaft axes of the first support part 114 and the second support part 115 coincide with each other and the difference of the lengths L1, L2 is substantially the same as that of the radius of the inner periphery of the first support part 114 and the radius of the other end portion 132B of the shaft part 132. Thus, when the other end portion 132B of the shaft part 132 abuts on the inner periphery of the first support part 114, the distance from the center of the cylindrical surface 112A to the leading end of the sheet member 134 is substantially uniform from the one end portion-side of the sheet member 134 to the other end portion-side thereof. Thereby, when the sheet member 134 is separated from the inclined surface 112B, the one end portion-side and other end portion-side of the sheet member 134 are separated at the same time. Thus, the force of the toner conveyance member 130 conveying the toner T becomes substantially uniform, irrespective of positions in the axis line direction.

Although the illustrative embodiment of the invention has been described, it should be noted that the invention is not limited to the above illustrative embodiment. The specific configuration can be appropriately changed without departing from the gist of the invention.

In the above illustrative embodiment, the elastic part 134A of the sheet member 134 has the trapezoidal shape, so that the distance from the center of the shaft part 132 to the leading end of the sheet member 134 is gradually increased from the one end portion 132A-side of the shaft part 132 towards the other end portion 132B. However, the invention is not limited thereto.

Figure 5:
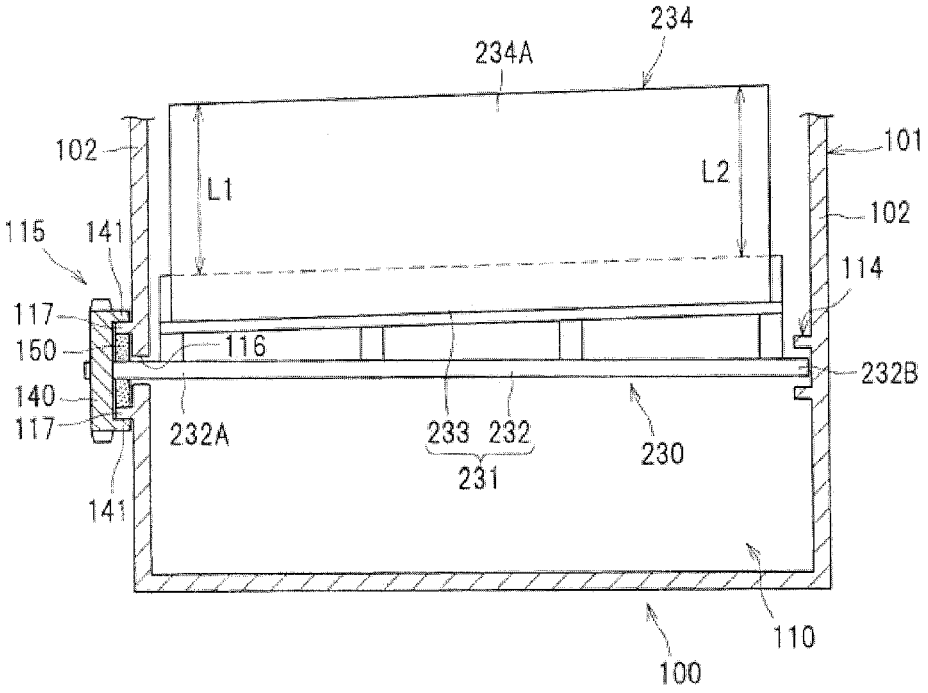
FIG. 5 is a sectional view of a developing cartridge showing a toner conveyance member according to a modified embodiment.

For example, as shown in FIG. 5, a rotation member 231 may have a trapezoidal shape, so that a distance from a center of a shaft part 232 to a leading end of a sheet member 234 is gradually increased from a one end portion 232A-side of the shaft part 232 towards the other end portion 232B-side.

Specifically, the rotation member 231 is formed so that a length from the center of the shaft part 232 to a leading end of a sheet attachment part 233, to which the sheet member 234 is attached, at an end portion of the other end portion 232B-side of the shaft 232, is longer than a length from the center of the shaft part 232 to a leading end of a sheet attachment part 233, to which the sheet member 234 is attached, at an end portion of the one end portion 232A-side of the shaft part 232.

The sheet member 234 is formed so that an elastic part 234A extending from the sheet attachment part 233 of the sheet member 234 has a parallelogram shape in which a length L2 at an end portion of the other end portion 232B-side of the shaft part 232 is the same as a length L1 at an end portion of the one end portion 232A-side of the shaft 232. That is, the elastic part 234A is formed so that a length from the sheet attachment part 233 (the rotation member 231) to the leading end is substantially the same in a range between an end portion at the one end portion 232A-side of the shaft part 232 and an end portion at the other end portion 232B-side of the shaft 232.

In the above illustrative embodiment, the sheet member 134 is one sheet having the trapezoidal shape. However, the invention is not limited thereto. For example, the sheet member may consist of a plurality of sheets having different lengths. Even with the sheet member, the sheets are arranged from one end portion in order of length from shortest to longest and are attached to the sheet attachment part 133, so that the distance from the center of the shaft part 132 of the toner conveyance member 130 to the leading end of the sheet member is gradually increased from the one end portion 132A-side of the shaft part 132 towards the other end portion 132B.

In the above illustrative embodiment, the shaft axes of the first support part 114 and the second support part 115 coincide with each other. However, the invention is not limited thereto. For example, the shaft axis of the second support part 115 may be arranged within a range of the first support part 114 in which the other end portion 132B of the shaft part 132 can be moved, when seen from an axis direction.

In the above illustrative embodiment, the sheet member 134 configuring the elastic part 134A is made of PET. However, the invention is not limited thereto. For example, the sheet member may be a film made of Teflon (registered trademark), urethane, PEEK (polyether ether ketone) resin, polycarbonate resin, nylon and the like, a thin metal plate made of stainless steel, phosphor bronze and the like, a rubber and the like.

What is claimed is:

1. A developer container comprising:

a conveyance member including a rotation member having a rotary shaft extending in a first direction, and an elastic part which is supported by the rotation member and is configured to be elastically deformed;

a driving member that is connected to one end portion of the rotary shaft and is configured to rotate the rotary shaft; and a container body configured to accommodate therein developer, the container body including:

a first side wall including a first support part configured to support the other end portion of the rotary shaft, the first support part being configured such that the other end portion of the rotary shaft is movable a first distance in a second direction perpendicular to the first direction;

a second side wall disposed apart from the first side wall in the first direction, the second side wall including a second support part configured to rotatably support the one end portion of the rotary shaft, the second support part being configured such that the one end portion of the rotary shaft is movable a second distance in the second direction, the second distance being shorter than the first distance; and a peripheral wall disposed between the first and second side walls, the peripheral wall including a sliding contact part that is provided in the vicinity of an upstream side in a rotating direction of the conveyance member with respect to an opening communicating an inside of the container body with an outside of the container body and that the elastic part slidingly-contacts while being elastically deformed when the conveyance member is being rotated, wherein a distance from an axial center of the rotary shaft to a leading end of the elastic part is gradually increased from the one end portion-side of the rotary shaft towards the other end portion-side of the rotary shaft.

2. The developer container according to claim 1, wherein a shaft axis of the first support part coincides with a shaft axis of the second support part.

3. The developer container according to claim 1, wherein a length of the elastic part from the rotation member to the leading end at an end portion of the other end portion-side of the rotary shaft is longer than a length of the elastic part from the rotation member to the leading end at an end portion of the one end portion-side of the rotary shaft.

4. The developer container according to claim 1, wherein:

a length of the elastic part from the rotation member to a leading end is substantially the same in a range between an end portion of the one end portion-side of the rotary shaft and an end portion of the other end portion-side of the rotary shaft, and a length of the rotary shaft from the axial center of the rotary shaft to a part, to which the elastic part is attached, at an end portion of the other end portion-side of the rotary shaft is longer than a length of the rotary shaft from the axial center of the rotary shaft to the part, to which the elastic part is attached, at an end portion of the one end portion-side of the rotary shaft.

5. The developer container according to claim 1, wherein a distance from the axial center of the rotary shaft to a leading end of the elastic part gradually and continuously increases from the one end portion-side of the rotary shaft towards the other end portion-side of the rotary shaft.

6. A developing device comprising:

a developing unit provided with a developing roller;

a conveyance member including a rotation member having a rotary shaft extending in a first direction, and an elastic part which is supported by the rotation member and is configured to be elastically deformed, the rotary shaft having one end portion and another end portion; and a developer accommodation unit configured to accommodate therein developer, the developer accommodation unit including:

a first side wall including a first support part configured to support the other end portion of the rotary shaft, the first support part being configured such that the other end portion of the rotary shaft is movable a first distance in a second direction perpendicular to the first direction;

a second side wall disposed apart from the first side wall in the first direction, the second side wall including a second support part configured to rotatably support the one end portion of the rotary shaft, the second support part being configured such that the one end portion of the rotary shaft is movable a second distance in the second direction, the second distance being shorter than the first distance; and a peripheral wall disposed between the first and second side walls, the peripheral wall including a sliding contact part that is provided in the vicinity of an upstream side in a rotating direction of the conveyance member with respect to an opening through which the developer accommodation unit communicates with the developing unit and that the elastic part sliding-contacts while being elastically deformed when the conveyance member is being rotated, wherein a distance from an axial center of the rotary shaft to a leading end of the elastic part is gradually increased from the one end portion-side of the rotary shaft towards the other end portion-side.

7. The developing device according to claim 6, wherein a shaft axis of the first support part coincides with a shaft axis of the second support part.

8. The developing device according to claim 6, wherein a length of the elastic part from the rotation member to the leading end at an end portion of the other end portion-side of the rotary shaft is longer than a length of the elastic part from the rotation member to the leading end at an end portion of the one end portion-side of the rotary shaft.

9. The developing device according to claim 6, wherein:

a length of the elastic part from the rotation member to a leading end is substantially the same at a range between an end portion of the one end portion-side of the rotary shaft and an end portion of the other end portion-side of the rotary shaft, and a length of the rotary shaft from the axial center of the rotary shaft to a part, to which the elastic part is attached, at an end portion of the other end portion-side of the rotary shaft is longer than a length of the rotary shaft from the axial center of the rotary shaft to the part, to which the elastic part is attached, at an end portion of the one end portion-side of the rotary shaft.

10. The developing device according to claim 6, wherein a distance from the axial center of the rotary shaft to a leading end of the elastic part gradually and continuously increases from the one end portion-side of the rotary shaft towards the other end portion-side of the rotary shaft.

11. A developer container comprising:

a conveyance member including a rotation member and an elastic part, the rotation member having a rotary shaft which has a first end portion and a second end portion and extends in a first direction, the elastic part being supported by the rotation member and configured to be elastically deformed;

a driving member which is connected to the second end portion of the rotary shaft and is configured to rotate the rotary shaft; and a container body configured to accommodate therein developer, the container body including:

a first side wall extending in a second direction perpendicular to the first direction and including a first support part configured to rotatably support the first end portion of the rotary shaft, the first support part having a first surface and a second surface which are configured to restrict movement of the first end portion of the rotary shaft in the second direction;

a second side wall disposed apart from the first side wall in the first direction and including a second support part configured to rotatably support the second end portion of the rotary shaft, the second support part having a third surface and a fourth surface which are configured to restrict movement of the second end portion of the rotary shaft in the second direction; and an upper wall disposed above the container body between the first side wall and the second side wall and extending in the first direction, the upper wall including a sliding contact part provided in an upstream side in a rotating direction of the conveyance member with respect to an opening communicating an inside of the container body with an outside of the container, the elastic part slidingly contacting the sliding contact part while being elastically deformed when the conveyance member rotates, wherein of a part of the first support part, the first surface is positioned closest to the upper wall, wherein the first surface is closer to the upper wall than the third surface in the second direction, wherein of a part of the second support part, the second surface is positioned farthest from the upper wall, and wherein the second surface is farther from the upper wall than the fourth surface in the second direction.

* * * * *